US012123064B2

(12) United States Patent
Shuto et al.

(10) Patent No.: US 12,123,064 B2
(45) Date of Patent: Oct. 22, 2024

(54) HOT-ROLLED STEEL SHEET

(71) Applicant: NIPPON STEEL CORPORATION, Tokyo (JP)

(72) Inventors: Hiroshi Shuto, Tokyo (JP); Koutarou Hayashi, Tokyo (JP); Hiroshi Kaido, Tokyo (JP); Akifumi Sakakibara, Tokyo (JP); Jun Ando, Tokyo (JP); Tetsu Asato, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 628 days.

(21) Appl. No.: 17/422,406

(22) PCT Filed: Jan. 30, 2020

(86) PCT No.: PCT/JP2020/003340
§ 371 (c)(1),
(2) Date: Jul. 12, 2021

(87) PCT Pub. No.: WO2020/179292
PCT Pub. Date: Sep. 10, 2020

(65) Prior Publication Data

US 2022/0119902 A1 Apr. 21, 2022

(30) Foreign Application Priority Data

Mar. 6, 2019 (JP) ..... 2019-040857

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| *C21D 1/02* | (2006.01) |

(52) U.S. Cl.

CPC ..... *C21D 8/0226* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 1/02* (2013.01); *C21D 2211/001* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 6,544,354 | B1 | 4/2003 | Kawano et al. | |
| 2014/0000769 | A1 | 1/2014 | Takahashi et al. | |
| 2014/0227556 | A1* | 8/2014 | Sato | C23C 2/0224 148/533 |
| 2014/0234659 | A1 | 8/2014 | Kawata et al. | |
| 2016/0017465 | A1 | 1/2016 | Toda et al. | |
| 2017/0044638 | A1 | 2/2017 | Yokoi et al. | |
| 2021/0095356 | A1 | 4/2021 | Yokoyama et al. | |
| 2022/0119902 | A1 | 4/2022 | Shuto et al. | |
| 2023/0133134 | A1* | 5/2023 | Sakakibara | C21D 8/0205 148/602 |

FOREIGN PATENT DOCUMENTS

| | | | |
|---|---|---|---|
| EP | 0 952 235 | A1 | 10/1999 |
| JP | 10-168544 | A | 6/1998 |
| JP | 11-61326 | A | 3/1999 |
| JP | 2001-32041 | A | 2/2001 |
| JP | 2005-179703 | A | 7/2005 |
| JP | 2005-298924 | A | 10/2005 |
| JP | 2007-70660 | A | 3/2007 |
| JP | 4109619 | B2 | 7/2008 |
| JP | 2010-275627 | A | 12/2010 |
| JP | 5655712 | B2 | 1/2015 |
| JP | 2015-151600 | A | 8/2015 |
| JP | 2017-145469 | A | 8/2017 |
| JP | 6241273 | B2 | 12/2017 |
| JP | 6414371 | B1 | 10/2018 |
| WO | WO 2012/128228 | A1 | 9/2012 |
| WO | WO 2013/047760 | A1 | 4/2013 |
| WO | 2014/171427 | A1 | 10/2014 |
| WO | WO 2015/118864 | A1 | 8/2015 |
| WO | WO 2015/162932 | A1 | 10/2015 |

OTHER PUBLICATIONS

U.S. Office Action for U.S. Appl. No. 17/907,883, dated Feb. 21, 2024.

* cited by examiner

*Primary Examiner* — Jophy S. Koshy
(74) *Attorney, Agent, or Firm* — Birch, Stewart, Kolasch & Birch, LLP

(57) ABSTRACT

This hot-rolled steel sheet has a predetermined chemical composition, in which a metal microstructure contains, by area %, 3.0% or more of residual austenite, has a ratio $L_{52}/L_7$ of a length $L_{52}$ of a grain boundary having a crystal orientation difference of 52° to a length $L_7$ of a grain boundary having a crystal orientation difference of 7° about a <110> direction of 0.10 or more and 0.18 or less, has a standard deviation of a Mn concentration of 0.60 mass % or less, and has a tensile strength of 980 MPa or more.

2 Claims, 1 Drawing Sheet

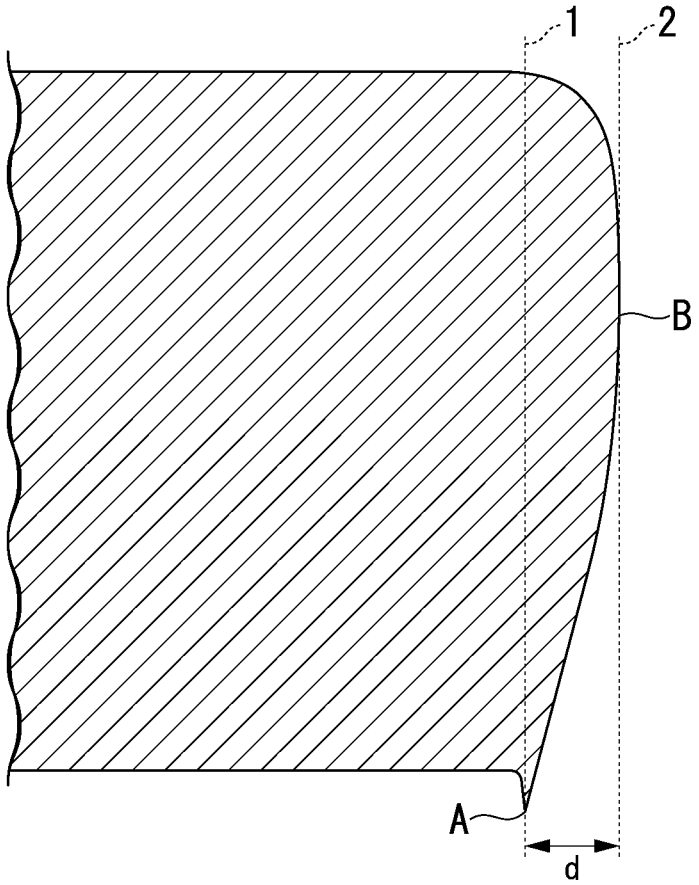
1
2
B
A
d

HOT-ROLLED STEEL SHEET

TECHNICAL FIELD OF THE INVENTION

The present invention relates to a hot-rolled steel sheet. Specifically, the present invention relates to a hot-rolled steel sheet that is formed into various shapes by press working or the like to be used, and particularly relates to a hot-rolled steel sheet that has high strength and has excellent ductility and shearing workability.

Priority is claimed on Japanese Patent Application No. 2019-040857, filed on Mar. 6, 2019, the content of which is incorporated herein by reference.

RELATED ART

In recent years, from the viewpoint of protecting the global environment, efforts have been made to reduce the amount of carbon dioxide gas emitted in many fields. Vehicle manufacturers are also actively developing techniques for reducing the weight of vehicle bodies for the purpose of reducing fuel consumption. However, it is not easy to reduce the weight of vehicle bodies since the emphasis is placed on improvement in collision resistance to secure the safety of the occupants.

Here, in order to achieve both vehicle body weight reduction and collision resistance, an investigation has been conducted to make a member thin by using a high strength steel sheet. Therefore, steel sheets having both high strength and excellent formability are strongly desired, and some techniques have been conventionally proposed in order to meet these demands. Among these, steel sheets containing residual austenite exhibit excellent ductility by transformation-induced plasticity (TRIP), and therefore many investigations have been conducted so far.

For example, Patent Document 1 discloses a high strength steel sheet for a vehicle having excellent collision resistant safety and formability, in which residual austenite having an average grain size of 5 μm or less is dispersed in ferrite having an average grain size of 10 μm or less. In the steel sheet containing residual austenite in the metal microstructure, while the austenite is transformed into martensite during working and large elongation is exhibited due to transformation-induced plasticity, the formation of hard martensite impairs hole expansibility. Patent Document 1 discloses that not only ductility but also hole expansibility are improved by refining the ferrite and the residual austenite.

Patent Document 2 discloses a high strength steel sheet having excellent elongation and stretch flangeability and having a tensile strength of 980 MPa or more, in which a second phase constituted of residual austenite and/or martensite is finely dispersed in crystal grains.

Patent Documents 3 and 4 disclose a high tensile hot-rolled steel sheet having excellent ductility and stretch flangeability, and a method for manufacturing the same. Patent Document 3 discloses a method for manufacturing a high strength hot-rolled steel sheet having good ductility and stretch flangeability, and is a method including cooling a steel sheet to a temperature range of 720° C. or lower within 1 second after the completion of hot rolling, retaining the steel sheet in a temperature range of higher than 500° C. and 720° C. or lower for a retention time of 1 to 20 seconds, and then the coiling the steel sheet in a temperature range of 350° C. to 500° C. In addition, Patent Document 4 discloses a high strength hot-rolled steel sheet that has good ductility and stretch flangeability and includes bainite as a primary phase and an appropriate amount of polygonal ferrite and residual austenite, in which in a steel structure excluding the residual austenite, an average grain size of grains surrounded by a grain boundary having a crystal orientation difference of 15° or more is 15 μm or less.

PRIOR ART DOCUMENT

Patent Document

[Patent Document 1] Japanese Unexamined Patent Application, First Publication No. H11-61326
[Patent Document 2] Japanese Patent No. 4109619
[Patent Document 3] Japanese Patent No. 5655712
[Patent Document 4] Japanese Patent No. 6241273

DISCLOSURE OF THE INVENTION

Problems to be Solved by the Invention

Since there are various working methods for vehicle members, the required formability differs depending on members to which the working methods are applied, but among these, ductility is placed as important indicators for formability. In addition, vehicle members are formed by press forming, and the press-formed blank sheet is often manufactured by highly productive shearing. In particular, for a steel sheet having a high strength of 980 MPa or more, the load required for a post-treatment such as coining after shearing is large, and thus it is desired to control the height difference on an end surface after shearing with particularly high accuracy.

All techniques disclosed in Patent Documents 1 to 4 are for improving a press formability such as ductility and elongation hole expansibility, but there is no mention of a technique for improving shearing workability, and a post-treatment is required at a stage of press forming a member, and it is estimated that manufacturing costs will increase.

The present invention has been made in view of the above problems of the related art, and an object of the present invention is to provide a hot-rolled steel sheet having high strength and excellent ductility and shearing workability.

Means for Solving the Problem

In view of the above-mentioned problems, as a result of intensive investigations on the chemical composition of a hot-rolled steel sheet and the relationship between the metal microstructure and the mechanical properties, the present inventors have obtained the following findings (a) to (h) and thus completed the present invention. In addition, the expression of having excellent shearing workability refers to that a height difference on an end surface after shearing is small. In addition, the expression of having high strength or having excellent strength refers to that tensile (maximum) strength is 980 MPa or more.

(a) In order to obtain the excellent tensile (maximum) strength, a primary phase structure of a metal microstructure is preferably full hard. That is, it is preferable that a soft microstructural fraction of ferrite, bainite, or the like is as small as possible.

(b) However, since the hard structure is a structure having poor ductility, excellent ductility cannot be secured simply with the metal microstructure mainly having the hard structures.

(c) In order for a hot-rolled steel sheet having high strength to also have excellent ductility, it is effective to contain an appropriate amount of residual austenite that can enhance the ductility by transformation-induced plasticity (TRIP).

(d) In order to stabilize the residual austenite at a room temperature, it is effective to concentrate C diffused from bainite and tempered martensite during coiling into austenite. Therefore, it is effective to secure the minimum retention time after the transformation of bainite and tempered martensite is stopped. However, when this retention time becomes too long, the austenite is decomposed and the amount of residual austenite is reduced. Therefore, it is effective to set appropriate retention time.

(e) A hard structure is generally formed in a phase transformation at 600° C. or lower, but in this temperature range, a large number of a grain boundary having a crystal orientation difference of 52° and a grain boundary having a crystal orientation difference of 7° about the <110> direction in the temperature range are formed.

(f) When forming the grain boundary having a crystal orientation difference of 7° about the <110> direction, dislocations are less likely to accumulate in a full hard structure. Therefore, in a metal microstructure in which the grain boundary having a crystal orientation difference of 7° about the <110> direction has high density and is uniformly dispersed, that is, in a metal microstructure in which the grain boundary having a crystal orientation difference of 7° about the <110> direction has a large total length, dislocation can be easily introduced into the metal microstructure during shearing, and distortion of the material during shearing is promoted. As a result, the height difference on the end surface after shearing is suppressed.

(g) In order to uniformly disperse the grain boundary having a crystal orientation difference of 7° and the grain boundary having a crystal orientation difference of 52 about the <110> direction, a standard deviation of a Mn concentration is required to be equal to or less than a certain value. In order to set the standard deviation of the Mn concentration to be equal to or less than a certain value, when a slab is heated, it is effective to allow the slab to retain in a temperature range of 700° C. to 850° C. for 900 seconds or longer, retain at 1100° C. or higher for 6000 seconds or longer, and perform hot rolling so that a total sheet thickness is reduced by 90% or more in the temperature range of 850° C. to 1100° C. Since microsegregation of Mn is reduced by preferably controlling retaining time in the temperature range of 700° C. to 850° C. and the sheet thickness reduction in the temperature range of 850° C. to 1100° C., the standard deviation of the Mn concentration can be set to be equal to or less than a certain value. As a result, the grain boundary having a crystal orientation difference of 7° and the grain boundary having a crystal orientation difference of 52° about the <110> direction can be uniformly distributed, and height difference on the end surface after shearing is reduced.

(h) In order to increase the length of the grain boundary having a crystal orientation difference of 7° and decrease the length of the grain boundary having a crystal orientation difference of 52° about the <110> direction, it is effective to set a coiling temperature to a predetermined temperature or higher.

The gist of the present invention made based on the above findings is as follows.

(1) A hot-rolled steel sheet according to an aspect of the present invention includes, as a chemical composition, by mass %, C: 0.100% to 0.250%;
Si: 0.05% to 3.00%;
Mn: 1.00% to 4.00%;
sol. Al: 0.001% to 2.000%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.000%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, and W: 0% to 1.00% in total;
Sn: 0% to 0.050%; and
a remainder comprising Fe and impurities,
in which a metal microstructure at a depth of ¼ of a sheet thickness from a surface and at a center position in a sheet width direction in a cross section parallel to a rolling direction contains, by area %, 3.0% or more of residual austenite, has a ratio $L_{52}/L_7$ of a length $L_{52}$ of a grain boundary having a crystal orientation difference of 52° to a length $L_7$ of a grain boundary having a crystal orientation difference of 7° about a <110> direction of 0.10 or more and 0.18 or less, has a standard deviation of a Mn concentration of 0.60 mass % or less, and has a tensile strength of 980 MPa or more.

(2) The hot-rolled steel sheet according to (1) may include, as the chemical composition, by mass %, one or two or more selected from the group consisting of:

Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.010% to 1.000%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

Effects of the Invention

According to the above aspect of the present invention, it is possible to obtain a hot-rolled steel sheet having excellent strength, ductility, and shearing workability. The hot-rolled steel sheet according to the above aspect of the present invention is suitable as an industrial material used for vehicle members, mechanical structural members, and building members.

BRIEF DESCRIPTION OF THE DRAWING

FIG. 1 is a diagram showing a method of measuring height difference on an end surface after shearing.

EMBODIMENTS OF THE INVENTION

The chemical composition and metal microstructure of a hot-rolled steel sheet (hereinafter, sometimes simply referred to as a steel sheet) according to an embodiment will be described in detail below. However, the present invention is not limited to the configuration disclosed in the present embodiment, and various modifications can be made without departing from the spirit of the present invention.

The numerical limit range described below includes the lower limit and the upper limit. Regarding the numerical value indicated by "less than" or "more than", the value does not fall within the numerical range. In the following description, % regarding the chemical composition of the hot-rolled steel sheet is mass % unless otherwise specified.

1. Chemical Composition

The hot-rolled steel sheet according to the present embodiment includes, by mass %, C: 0.100% to 0.250%, Si: 0.05% to 3.00%, Mn: 1.00% to 4.00%, sol. Al: 0.001% to 2.000%, P: 0.100% or less, S: 0.0300% or less, N: 0.1000% or less, O: 0.0100% or less, and a remainder comprising Fe and impurities. Each element will be described in detail below.

(1-1) C: 0.100% to 0.250%

C has an action of stabilizing residual austenite. When the C content is less than 0.100%, it is difficult to obtain a desired residual austenite area fraction. Therefore, the C content is set to 0.100% or more. The C content is preferably 0.120% or more and more preferably 0.150% or more. On the other hand, when the C content is more than 0.250%, pearlite is preferentially formed to insufficiently form residual austenite, and thus it is difficult to obtain the desired residual austenite area fraction. Therefore, the C content is set to 0.250% or less. The C content is preferably 0.220% or less.

(1-2) Si: 0.05% to 3.00%

Si has an action of delaying the precipitation of cementite. By this action, the amount of austenite remaining in an untransformed state, that is, the area fraction of the residual austenite can be enhanced, and the strength of the steel sheet can be enhanced by solid solution strengthening. In addition, Si has an action of making the steel sound by deoxidation (suppressing the occurrence of defects such as blow holes in the steel). When the Si content is less than 0.05%, an effect by the action cannot be obtained. Therefore, the Si content is set to 0.05% or more. The Si content is preferably 0.50% or more or 1.00% or more. However, when the Si content is more than 3.00%, the surface properties, the chemical convertibility, the ductility and the weldability of the steel sheet are significantly deteriorated, and the $A_3$ transformation point is significantly increased. This makes it difficult to perform hot rolling in a stable manner. Therefore, the Si content is set to 3.00% or less. The Si content is preferably 2.70% or less or 2.50% or less.

(1-3) Mn: 1.00% to 4.00%

Mn has actions of suppressing ferritic transformation and high-strengthening the steel sheet. When the Mn content is less than 1.00%, the tensile strength of 980 MPa or more cannot be obtained. Therefore, the Mn content is set to 1.00% or more. The Mn content is preferably 1.50% or more and more preferably 1.80% or more. On the other hand, when the Mn content is more than 4.00%, the bainitic transformation is delayed, the carbon concentration to austenite is not promoted, and residual austenite is insufficiently formed. Thus, it is difficult to obtain the desired area fraction of residual austenite. Further, it is difficult to increase the C concentration in the residual austenite. Therefore, the Mn content is set to 4.00% or less. The Mn content is preferably 3.70% or less or 3.50% or less.

(1-4) sol. Al: 0.001% to 2.000%

Similar to Si, Al has an action of deoxidizing the steel to make the steel sheet sound, and also has an action of promoting the formation of residual austenite by suppressing the precipitation of cementite from austenite. When the sol. Al content is less than 0.001%, the effect by the action cannot be obtained. Therefore, the sol. Al content is set to 0.001% or more. The sol. Al content is preferably 0.010% or more. On the other hand, when the sol. Al content is more than 2.000%, the above effects are saturated and this case is not economically preferable. Thus, the sol. Al content is set to 2.000% or less. The sol. Al content is preferably 1.500% or less or 1.300% or less.

(1-5) P: 0.100% or less

P is an element that is generally contained as an impurity and is also an element having an action of enhancing the strength by solid solution strengthening. Therefore, although P may be positively contained, P is an element that is easily segregated, and when the P content is more than 0.100%, the formability and toughness are significantly decreased due to the boundary segregation. Therefore, the P content is limited to 0.100% or less. The P content is preferably 0.030% or less. The lower limit of the P content does not need to be particularly specified, but is preferably 0.001% from the viewpoint of refining cost.

(1-6) S: 0.0300% or less

S is an element that is contained as an impurity and forms sulfide-based inclusions in the steel to decrease the formability of the hot-rolled steel sheet. When the S content is more than 0.0300%, the formability of the steel sheet is significantly decreased. Therefore, the S content is limited to 0.0300% or less. The S content is preferably 0.0050% or less. The lower limit of the S content does not need to be particularly specified, but is preferably 0.0001% from the viewpoint of refining cost.

(1-7) N: 0.1000% or less

N is an element contained in steel as an impurity and has an action of decreasing the formability of the steel sheet. When the N content is more than 0.1000%, the formability of the steel sheet is significantly decreased. Therefore, the N content is set to 0.1000% or less. The N content is preferably 0.0800% or less and more preferably 0.0700% or less. Although the lower limit of the N content does not need to be particularly specified, as will be described later, in a case where one or two or more of Ti, Nb, and V are contained to refine the metal microstructure, the N content is preferably 0.0010% or more and more preferably 0.0020% or more to promote the precipitation of carbonitride.

(1-8) O: 0.0100% or less

When a large amount of O is contained in the steel, O forms a coarse oxide that becomes the origin of fracture, and causes brittle fracture and hydrogen-induced cracks. Therefore, the O content is limited to 0.0100% or less. The O content is preferably 0.0080% or less and 0.0050% or less. The O content may be 0.0005% or more or 0.0010% or more to disperse a large number of fine oxides when the molten steel is deoxidized.

The remainder of the chemical composition of the hot-rolled steel sheet according to the present embodiment includes Fe and impurities. In the present embodiment, the impurities mean those mixed from ore as a raw material, scrap, manufacturing environment, and the like, and are allowed within a range that does not adversely affect the hot-rolled steel sheet according to the present embodiment.

In addition to the above elements, the hot-rolled steel sheet according to the present embodiment may contain Ti, Nb, V, Cu, Cr, Mo, Ni, B, Ca, Mg, REM, Bi, Zr, Co, Zn, W, and Sn as optional elements. In a case where the above optional elements are not contained, the lower limit of the content thereof is 0%. Hereinafter, the above optional elements will be described in detail.

(1-9) Ti: 0.005% to 0.300%, Nb: 0.005% to 0.100%, and V: 0.005% to 0.500%

Since all of Ti, Nb, and V are precipitated as carbides or nitrides in the steel and have an action of refining the metal microstructure by an austenite pinning effect, one or two or more of these elements may be contained. In order to more reliably obtain the effect by the action, it is preferable that the Ti content is set to 0.005% or more, the Nb content is set to 0.005% or more, or the V content is set to 0.005% or more. However, even when these elements are excessively contained, the effect by the action is saturated, and this case is not economically preferable. Therefore, the Ti content is set to 0.300% or less, the Nb content is set to 0.100% or less, and the V content is set to 0.500% or less.

(1-10) Cu: 0.01% to 2.00%, Cr: 0.01% to 2.00%, Mo: 0.010% to 1.000%, Ni: 0.02% to 2.00%, and B: 0.0001% to 0.0100%

All of Cu, Cr, Mo, Ni, and B have an action of enhancing the hardenability of the steel sheet. In addition, Cr and Ni have an action of stabilizing residual austenite, and Cu and Mo have an effect of precipitating carbides in the steel to increase the strength. Further, in a case where Cu is contained, Ni has an action of effectively suppressing the grain boundary crack of the slab caused by Cu. Therefore, one or two or more of these elements may be contained.

Cu has an action of enhancing the hardenability of the steel sheet and an effect of precipitating as carbide in the steel at a low temperature to enhance the strength of the steel sheet. In order to more reliably obtain the effect by the action, the Cu content is preferably 0.01% or more and more preferably 0.05% or more. However, when the Cu content is more than 2.00%, grain boundary cracks may occur in the slab in some cases. Therefore, the Cu content is set to 2.00% or less. The Cu content is preferably 1.50% or less and 1.00% or less.

As described above, Cr has an action of enhancing the hardenability of the steel sheet and an action of stabilizing residual austenite. In order to more reliably obtain the effect by the action, the Cr content is preferably 0.01% or more or 0.05% or more. However, when the Cr content is more than 2.00%, the chemical convertibility of the steel sheet is significantly decreased. Accordingly, the Cr content is set to 2.00% or less.

As described above, Mo has an action of enhancing the hardenability of the steel sheet and an action of precipitating carbides in the steel to enhance the strength. In order to more reliably obtain the effect by the action, the Mo content is preferably 0.010% or more or 0.020% or more. However, even when the Mo content is more than 1.000%, the effect by the action is saturated, and this case is not economically preferable. Therefore, the Mo content is set to 1.000% or less. The Mo content is preferably 0.500% or less and 0.200% or less.

As described above, Ni has an action of enhancing the hardenability of the steel sheet. In addition, when Cu is contained, Ni has an action of effectively suppressing the grain boundary crack of the slab caused by Cu. In order to more reliably obtain the effect by the action, the Ni content is preferably 0.02% or more. Since Ni is an expensive element, it is not economically preferable to contain a large amount of Ni. Therefore, the Ni content is set to 2.00% or less.

As described above, B has an action of enhancing the hardenability of the steel sheet. In order to more reliably obtain the effect by the action, the B content is preferably 0.0001% or more or 0.0002% or more. However, when the B content is more than 0.0100%, the formability of the steel sheet is significantly decreased, and thus the B content is set to 0.0100% or less. The B content is preferably 0.0050% or less.

(1-11) Ca: 0.0005% to 0.0200%, Mg: 0.0005% to 0.0200%, REM: 0.0005% to 0.1000%, and Bi: 0.0005% to 0.020%

All of Ca, Mg, and REM have an action of enhancing the formability of the steel sheet by adjusting the shape of inclusions to a preferable shape. In addition, Bi has an action of enhancing the formability of the steel sheet by refining the solidification structure. Therefore, one or two or more of these elements may be contained. In order to more reliably obtain the effect by the action, it is preferable that any one or more of Ca, Mg, REM, and Bi is 0.0005% or more. However, when the Ca content or Mg content is more than 0.0200%, or when the REM content is more than 0.1000%, the inclusions are excessively formed in the steel, and thus the formability of the steel sheet may be decreased in some cases. In addition, even when the Bi content is more than 0.020%, the above effect by the action is saturated, and this case is not economically preferable. Therefore, the Ca content and Mg content are set to 0.0200% or less, the REM content is set to 0.1000% or less, and the Bi content is set to 0.020% or less. The Bi content is preferably 0.010% or less.

Here, REM refers to a total of 17 elements made up of Sc, Y and lanthanoid, and the REM content refers to the total content of these elements. In the case of lanthanoid, lanthanoid is industrially added in the form of misch metal.

(1-12) One or Two or More of Zr, Co, Zn and W: 0% to 1.00% in total and Sn: 0% to 0.050%

Regarding Zr, Co, Zn, and W, the present inventors have confirmed that even when the total content of these elements is 1.00% or less, the effect of the hot-rolled steel sheet according to the present embodiment is not impaired. Therefore, one or two or more of Zr, Co, Zn, and W may be contained in a total of 1.00% or less.

In addition, the present inventors have confirmed that the effects of the hot-rolled steel sheet according to the present embodiment are not impaired even when a small amount of Sn is contained, but defects may be generated at the time of hot rolling. Thus, the Sn content is set to 0.050% or less.

The above-described chemical composition of the hot-rolled steel sheet may be measured by a general analytical method. For example, inductively coupled plasma-atomic emission spectrometry (ICP-AES) may be used for measurement. In addition, sol. Al may be measured by the ICP-AES using a filtrate after heat-decomposing a sample with an acid. C and S may be measured by using a combustion-infrared absorption method, and N may be measured by using the inert gas melting-thermal conductivity method.

2. Metal Microstructure of Hot-Rolled Steel Sheet

Next, the metal microstructure of the hot-rolled steel sheet according to the present embodiment will be described.

The hot-rolled steel sheet according to the present embodiment has the above-described chemical composition, in which a metal microstructure at a depth of ¼ of a sheet thickness from a surface and at a center position in a sheet width direction in a cross section parallel to a rolling direction contains, by area %, 3.0% or more of residual austenite, has a ratio $L_{52}/L_7$ of a length $L_{52}$ of a grain boundary having a crystal orientation difference of 52° to a length $L_7$ of a grain boundary having a crystal orientation difference of 7° about a <110> direction of 0.10 or more and 0.18 or less and has a standard deviation of a Mn concentration of 0.60 mass % or less. Therefore, in the hot-rolled steel sheet according to the present embodiment, it is possible to obtain excellent strength, ductility, and shearing workability.

In the present embodiment, the reason for defining the metal microstructure at the depth of ¼ of the sheet thickness from the surface and the center position in the sheet width direction in the cross section parallel to the rolling direction is that the metal microstructure at this position is a typical metal microstructure of the steel sheet.

(2-1) Area Fraction of Residual Austenite: 3.0% or More

The residual austenite is a metal microstructure that is present as a face-centered cubic lattice even at room temperature. The residual austenite has an action of increasing the ductility of the steel sheet due to transformation-induced plasticity (TRIP). When the area fraction of the residual austenite is less than 3.0%, the effect by the action cannot be obtained and the ductility of the steel sheet is deteriorated. Therefore, the area fraction of the residual austenite is set to 3.0% or more. The area fraction of the residual austenite is preferably 5.0% or more, more preferably 7.0% or more, and even more preferably 8.0% or more. The upper limit of the area fraction of the residual austenite does not need to be particularly specified, but since the area fraction of the residual austenite that can be secured in the chemical composition of the hot-rolled steel sheet according to the present embodiment is approximately 20.0%, the upper limit of the area fraction of the residual austenite may be set to 20.0%. The area fraction of the residual austenite may be 15.0% or less.

In the hot-rolled steel sheet according to the present embodiment, the metal microstructure other than the residual austenite is not particularly limited as long as the tensile strength is 980 MPa or more. As the metal microstructure other than the residual austenite, a low temperature phase including martensite, bainite, and auto-tempered martensite of which a total area fraction is 80.0 to 97.0% may be contained.

As the measurement method of the area fraction of the residual austenite, methods by X-ray diffraction, electron back scatter diffraction image (EBSP, electron back scattering diffraction pattern) analysis, and magnetic measurement and the like may be used and the measured values may differ depending on the measurement method. In this embodiment, the area fraction of the residual austenite is measured by X-ray diffraction.

In the measurement of the area fraction of the residual austenite by X-ray diffraction in the present embodiment, first, the integrated intensities of a total of 6 peaks of α(110), α(200), α(211), γ(111), γ(200), and γ(220) are obtained in the cross section parallel to the rolling direction at a depth of ¼ of the sheet thickness of the steel sheet and the center position in the sheet width direction, using Co-Kα rays, and the area fraction of the residual austenite is obtained by calculation using the strength averaging method. The area fraction of the metal microstructure other than the residual austenite may be obtained by subtracting the area fraction of the residual austenite from 100.0%.

(2-2) Ratio $L_{52}/L_7$ of a Length $L_{52}$ of a Grain Boundary having Crystal Orientation Difference of 52° to a Length $L_7$ of a Grain Boundary having Crystal Orientation Difference of 7° about ≤110> Direction: 0.10 or More and 0.18 or Less In order to obtain a high strength of 980 MPa or more, the primary phase is required to have a hard structure. The hard structure is generally formed in phase transformation at 600° C. or lower. A large number of a grain boundary having a crystal orientation difference of 52° and a grain boundary having a crystal orientation difference of 7° about the <110> direction in the temperature range at 600° C. or lower are formed. When forming the grain boundary having a crystal orientation difference of 7° about the <110> direction, dislocations are less likely to accumulate in a hard structure. Therefore, in a metal microstructure in which the grain boundary having a crystal orientation difference of 7° about the <110> direction have high density and are uniformly dispersed, that is, the grain boundary having a crystal orientation difference of 7° about the <110> direction have a large total length, dislocation can be easily introduced into the metal microstructure during shearing, and distortion of the material during shearing is promoted. As a result, the height difference on the end surface after shearing is suppressed.

On the other hand, in the grain boundary having a crystal orientation difference of 52° about the <110> direction, dislocations are likely to accumulate in a hard phase. Therefore, since it is difficult to introduce dislocation into the metal microstructure during shearing, and the material breaks immediately during shearing, the height difference on the end surface after shearing becomes large. Therefore, when the length of a grain boundary having a crystal orientation difference of 52° is set to $L_{52}$ and the length of the grain boundary having a crystal orientation difference of 7° about a <110> direction is set to $L_7$, the height difference on the end surface after shearing is dominated by $L_{52}/L_7$. When $L_{52}/L_7$ is less than 0.10, dislocation are extremely unlikely to accumulate in the hard phase. Therefore, the tensile strength of the hot-rolled steel sheet cannot be 980 MPa or more. Further, when $L_{52}/L_7$ is more than 0.18, the height difference on the end surface after shearing becomes large. Therefore, it is necessary to set $L_{52}/L_7$ to 0.10 or more and 0.18 or less in order to reduce the height difference on the end surface after shearing while obtaining the desired strength.

The grain boundary having a crystal orientation difference of X° about the <110> direction refers to a grain boundary having a crystallographic relationship in which the crystal orientations of the crystal grain A and the crystal grain B are the same by rotating one crystal grain B by X° about the <110> axis, when two adjacent crystal grain A and crystal grain B are specified at a certain grain boundary. However, considering the measurement accuracy of the crystal orientation, an orientation difference of +4° is allowed from the matching orientation relationship.

In the present embodiment, the length $L_{52}$ of the grain boundary having a crystal orientation difference of 52° and the length $L_7$ of a grain boundary having a crystal orientation difference of 7° about the <110> direction are measured by using the electron back scatter diffraction pattern-orientation image microscopy (EBSP-OIM) method. In the EBSP-OIMTM method, a crystal orientation of an irradiation point can be measured for a short time period in such manner that a highly inclined sample in a scanning electron microscope (SEM) is irradiated with electron beams, a Kikuchi pattern formed by back scattering is photographed by a high sensitive camera, and the photographed image is processed by a computer. The EBSP-OIM method is performed using a device in which a scanning electron microscope and an EBSP analyzer are combined and an OIM Analysis (registered trademark) manufactured by AMETEK Inc. In the EBSP-OIM method, since the fine structure of the sample surface and the crystal orientation can be analyzed, the length of the grain boundary having a specific crystal orientation difference can be quantitatively determined. The analyzable area of the EBSP-OIM method is a region that can be observed by the SEM. The EBSP-OIM method makes it possible to analyze a region with a minimum resolution of 20 nm, which varies depending on the resolution of the SEM.

When measuring the length of specific grain boundary of the metal microstructure at the depth of ¼ of the sheet thickness from the surface of the steel sheet and at the center position in the sheet width direction in the cross section parallel to the rolling direction, an analysis is performed in at least 5 visual fields of a region of 40 μm×30 μm at a magnification of 1200 times and an average value of the lengths of the grain boundary having a crystal orientation difference of 52° about the <110> direction is calculated to obtain $L_{52}$. Similarly, an average value of the lengths of the grain boundary having a crystal orientation difference of 7° about the <110> direction is calculated to obtain $L_7$. As described above, the orientation difference of +4° is allowed.

Since the residual austenite is not a structure formed by phase transformation at 600° C. or lower and has no effect of dislocation accumulation, the residual austenite is not included as a target in the analysis in the present measurement method. In the EBSP-OIM method, the residual austenite can be excluded from the analysis target.

(2-3) Standard Deviation of Mn Concentration: 0.60 Mass % or Less

The standard deviation of Mn concentration at the depth of ¼ of the sheet thickness from the surface of the hot-rolled steel sheet according to the present embodiment and the center position in the sheet width direction is 0.60 mass % or less. Accordingly, the grain boundary having a crystal orientation difference of 7° and the grain boundary having a crystal orientation difference of 52° about the <110> direction can be uniformly dispersed. As a result, the height difference on the end surface after shearing can be suppressed. A lower limit of the standard deviation of the Mn concentration is preferably as small as the value from the viewpoint of suppressing the height difference on the end surface after the shearing, but a practical lower limit is 0.10 mass % due to the restrictions of the manufacturing process.

For the standard deviation of the Mn concentration, the L cross section of the hot-rolled steel sheet is mirror polished, and the Mn concentration at the depth of ¼ of the sheet thickness from the surface and the center position in the sheet width direction is measured using electron probe microanalyzer (EPMA) to calculate and obtain the standard deviation. The measurement condition is set such that an acceleration voltage is 15 kV and the magnification is 5000 times, and a distribution image in the range of 20 μm in the sample rolling direction and 20 μm in the sample sheet thickness direction is measured. More specifically, the measurement interval is set to 0.1 μm, and the Mn concentration at 40000 or more points is measured. Then, a standard deviation based on the Mn concentration obtained from all the measurement point is calculated to obtain the standard deviation of the Mn concentration.

3. Tensile Strength Properties

The hot-rolled steel sheet according to the present embodiment has a tensile (maximum) strength of 980 MPa or more. When the tensile strength is less than 980 MPa, an applicable part is limited, and the contribution of weight reduction of the vehicle body is small. An upper limit is not particularly limited, and may be 1780 MPa, 1200 MPa, or 1150 MPa from the viewpoint of suppressing wearing of die.

The tensile strength is measured according to JIS Z 2241: 2011 using a No. 5 test piece of JIS Z 2241: 2011. The sampling position of the tensile test piece may be 1/4 portion from the end portion in the sheet width direction, and the direction perpendicular to the rolling direction may be the longitudinal direction.

4. Sheet Thickness

The sheet thickness of the hot-rolled steel sheet according to the present embodiment is not particularly limited and may be 0.5 to 8.0 mm. By setting the sheet thickness of the hot-rolled steel sheet to 0.5 mm or more, it becomes easy to secure the rolling completion temperature, and it is also possible to suppress an excessive rolling force, and to easily perform hot rolling. Therefore, the sheet thickness of the steel sheet according to the present invention may be 0.5 mm or more. The sheet thickness is preferably 1.2 mm or more and 1.4 mm or more. In addition, when the sheet thickness is set to 8.0 mm or less, The metal microstructure can be easily refined, and the above-described metal microstructure can be easily secured. Therefore, the sheet thickness may be 8.0 mm or less. The sheet thickness is preferably 6.0 mm or less.

5. Others (5-1) Plating Layer

The hot-rolled steel sheet according to the present embodiment having the above-described chemical composition and metal microstructure may be a surface-treated steel sheet provided with a plating layer on the surface for the purpose of improving corrosion resistance and the like. The plating layer may be an electro plating layer or a hot-dip plating layer. Examples of the electro plating layer include electrogalvanizing and electro Zn—Ni alloy plating. Examples of the hot-dip plating layer include hot-dip galvanizing, hot-dip galvannealing, hot-dip aluminum plating, hot-dip Zn—Al alloy plating, hot-dip Zn—Al—Mg alloy plating, and hot-dip Zn—Al—Mg—Si alloy plating. The plating adhesion amount is not particularly limited and may be the same as before. Further, it is also possible to further enhance the corrosion resistance by performing an appropriate chemical conversion treatment (for example, by applying and drying a silicate-based chromium-free chemical conversion treatment liquid) after plating.

6. Manufacturing Conditions

A suitable method for manufacturing the hot-rolled steel sheet according to the present embodiment having the above-mentioned chemical composition and metal microstructure is as follows.

In order to obtain the hot-rolled steel sheet according to the present embodiment, it is effective that after performing heating the slab under predetermined conditions, hot rolling is performed and accelerated cooling is performed to a predetermined temperature range, and after coiling, the cooling history is controlled.

In the suitable method for manufacturing the hot-rolled steel sheet according to the present embodiment, the following steps (1) to (7) are sequentially performed. The temperature of the slab and the temperature of the steel sheet in the present embodiment refer to the surface temperature of the slab and the surface temperature of the steel sheet.

(1) The slab is retained in a temperature range of 700° C. to 850° C. for 900 seconds or longer, then heated, and retained at 1100° C. or higher for 6000 seconds or longer.

(2) Hot rolling is performed in a temperature range of 850° C. to 1100° C. so that the total sheet thickness is reduced by 90% or more.

(3) Hot rolling is completed at a temperature T1 (° C.) or higher represented by Expression <1>.

(4) Cooling is started within 1.5 seconds after the completion of the hot rolling, and the accelerated cooling is performed to temperature T2 (° C.) or lower represented by Expression <2> at an average cooling rate of 50° C./sec or higher.

(5) Cooling from the cooling stop temperature of the accelerated cooling to the coiling temperature is performed at an average cooling rate of 10° C./sec or higher.

(6) Coiling is performed at the temperature T3 (° C.) or higher represented by Expression <3>.

(7) In cooling after coiling, cooling is performed so that the lower limit of the retaining time satisfies Condition I (one or more of 80 seconds or longer at 450° C. or higher, 200 seconds or longer at 400° C. or higher, and 1000 seconds or longer at 350° C. or higher), and the upper limit of the retaining time satisfies Condition II (all of within 2000 seconds at 450° C. or higher, within 8000 seconds at 400° C. or higher, and within 30000 seconds at 350° C. or higher) in a predetermined temperature range at the endmost portion of the hot-rolled steel sheet in the sheet width direction and at the center portion in the sheet width direction.

$$T1(°\ C.)=868-396\times[C]-68.1\times[Mn]+24.6\times[Si]-36.1\times[Ni]-24.8\times[Cr]-20.7\times[Cu]+250\times[sol.Al] \quad <1>$$

$$T2)(°\ C.=770-270\times[C]-90\times[Mn]-37\times[Ni]-70\times[Cr]-83\times[Mo] \quad <2>$$

$$T3(°\ C.)=591-474\times[C]-33\times[Mn]-17\times[Ni]-17\times[Cr]—21\times[Mo] \quad <3>$$

However, the [element symbol] in each expression indicates the content (mass %) of each element in the steel. When an element is not contained, substitution is performed with 0.

(6-1) Slab, Slab Temperature When Subjected to Hot Rolling, and Retaining and Retention Time As a slab to be subjected to hot rolling, a slab obtained by continuous casting, a slab obtained by casting and blooming, and the like can be used, and slabs obtained by performing hot working or cold working on these slabs as necessary can be used. The slab to be subjected to hot rolling is preferably retained in a temperature range of 700° C. to 850° C. during heating for 900 seconds or longer, then further heated and retained at 1100° C. or higher for 6000 seconds or longer. In the austenite transformation at 700° C. to 850° C., when Mn is distributed between the ferrite and the austenite and the transformation time becomes longer, Mn can be diffused in the ferrite region. Accordingly, the Mn microsegregation unevenly distributed in the slab can be eliminated, and the standard deviation of the Mn concentration can be significantly reduced. As a result, the height difference on the end surface after shearing can be suppressed. Further, in order to make the austenite grains uniform during slab heating, it is preferable to heat the slab at 1100° C. or higher for 6000 seconds or longer.

In order to allow the slab to retain in the temperature range of 700° C. to 850° C. for 900 seconds or longer, a method of reducing a temperature gradient in the heating range where the slab temperature reaches 700° C. to 850° C. inside a heating furnace is used as an exemplary example.

In hot rolling, it is preferable to use a reverse mill or a tandem mill for multi-pass rolling. Particularly, from the viewpoint of industrial productivity, it is more preferable that at least the final several stages are hot-rolled using a tandem mill.

(6-2) Rolling Reduction of Hot Rolling: Total Sheet Thickness Reduction of 90% or More in Temperature Range of 850° C. to 1100° C.

It is preferable to perform the hot rolling in a temperature range of 850° C. to 1100° C. so that the total sheet thickness is reduced by 90% or more. Accordingly, the accumulation of strain energy inside unrecrystallized austenite grains is promoted while achieving refinement mainly of the recrystallized austenite grains. The atomic diffusion of Mn is promoted while promoting the recrystallization of the austenite. As a result, the standard deviation of the Mn concentration can be reduced, and the height difference on the end surface after shearing can be reduced.

The sheet thickness reduction in a temperature range of 850° C. to 1100° C. can be expressed as $(t_0-t_1)/t_0\times100$ (%) when an inlet sheet thickness before the first pass in the rolling in this temperature range is to and an outlet sheet thickness after the final pass in the rolling in this temperature range is $t_1$.

(6-3) Hot rolling Completion Temperature: T1 (° C.) or Higher

The hot rolling completion temperature is preferably set to T1)(° C. or higher. By setting the hot rolling completion temperature to T1 (C) or higher, an excessive increase in the number of ferrite nucleation sites in the austenite can be suppressed, and the formation of the ferrite in the final structure (the metal microstructure of the hot-rolled steel sheet after manufacturing) can be suppressed, and it is possible to obtain the hot-rolled steel sheet having high strength.

(6-4) Accelerated Cooling After Completion of Hot Rolling: Starting Cooling Within 1.5 Seconds and Performing Accelerated Cooling to T2 (C) or Lower at Average Cooling Rate of 50° C./Sec or Higher In order to suppress the growth of austenite crystal grains refined by hot rolling, it is preferable to perform accelerated cooling to T2 (° C.) or lower within 1.5 seconds after the completion of hot rolling at an average cooling rate of 50° C./sec or higher.

By performing accelerated cooling to T2 (C) or lower within 1.5 seconds after the completion of hot rolling at an average cooling rate of 50° C./sec or higher, the formation of ferrite and pearlite can be suppressed. Accordingly, the strength of the hot-rolled steel sheet is enhanced. The average cooling rate referred herein is a value obtained by dividing the temperature drop amount of the steel sheet from the start of accelerated cooling to the completion of accelerated cooling (when introducing a steel sheet to cooling equipment) to the completion of accelerated cooling (when deriving a steel sheet from cooling equipment) by the time required from the start of accelerated cooling to the completion of accelerated cooling. In the accelerated cooling after completion of hot rolling, when the time to start cooling is set to be within 1.5 seconds, the average cooling rate is set to 50° C./sec or higher, and the cooling stop temperature is set to T2 (° C.) or lower, the ferritic transformation and/or pearlitic transformation inside the steel sheet can be suppressed, and TS ≥980 MPa can be obtained. Therefore, within 1.5 seconds after the completion of hot rolling, it is preferable to perform accelerated cooling to T2 (C) or lower at an average cooling rate of 50° C./sec or higher. The upper limit of the cooling rate is not particularly specified, but when the cooling rate is increased, the cooling equipment becomes large and the equipment cost increases. Therefore, considering the equipment cost, the average cooling rate is preferably 300° C./sec or lower. Further, the cooling stop temperature of accelerated cooling may be T3 (° C.) or higher.

(6-5) Average Cooling Rate from Cooling Stop Temperature of Accelerated Cooling to Coiling Temperature: 10° C./Sec or Higher In order to suppress the area fraction of the pearlite to obtain the strength of TS ≥980 MPa, the average cooling rate from the cooling stop temperature of the accelerated cooling to the coiling temperature is preferably set to 10° C./sec or higher. Accordingly, the primary phase structure can be full hard. The average cooling rate referred here refers to a value obtained by dividing the temperature drop amount of the steel sheet from the cooling stop temperature of the accelerated cooling to the coiling temperature by the time required from the stop of accelerated cooling to coiling. By setting the average cooling rate to 10° C./sec or higher, the area fraction of pearlite can be reduced, and the strength and ductility can be secured. Therefore, the average cooling rate from the cooling stop temperature of the accelerated cooling to the coiling temperature is set to 10° C./sec or higher.

(6-6) Coiling Temperature: T3 (° C.) or Higher

The coiling temperature is preferably T3 (C) or higher. When setting the coiling temperature to T3 (° C.) or higher, the transformation driving force from austenite to bcc decreases and the distortion strength of austenite decreases. Therefore, when transformation into bainite and martensite, the length $L_{52}$ of the grain boundary having a crystal orientation difference of 52° about the <110> direction decreases, and the length $L_7$ of a grain boundary having a crystal orientation difference of 7° about the <110> direction increases. Thus, $L_{52}/L_7$ can be 0.18 or less. As a result, the height difference on the end surface after shearing can be suppressed. Therefore, the coiling temperature is preferably T3 (° C.) or higher.

(6-7) Cooling After Coiling: Cooling is Performed So That Lower Limit of

Retaining Time Satisfies Condition I, and Upper Limit of Retaining Time Satisfies Condition II in Predetermined Temperature Range After Coiling of Hot-Rolled Steel Sheet Condition I: any one of 80 seconds or longer at 450° C. or higher, 200 seconds or longer at 400° C. or higher, or 1000 seconds or longer at 350° C. or higher Condition II: all of within 2000 seconds at 450° C. or higher, within 8000 seconds at 400° C. or higher, and within 30000 seconds at 350° C. or higher In cooling after coiling, by performing cooling so that the lower limit of the retaining time satisfies Condition I in a predetermined temperature range, that is, by securing the retaining time satisfying any one of 80 seconds or longer at 450° C. or higher, 200 seconds or longer at 400° C. or higher, or 1000 seconds or longer at 350° C. or higher, the diffusion of carbon from the primary phase to the austenite is promoted, the area fraction of the residual austenite is increased, and the decomposition of the residual austenite is easily suppressed. As a result, it is possible to set the area fraction of residual austenite to 3.0% or more, and it is possible to improve the ductility of the hot-rolled steel sheet. In the present embodiment, the temperature of the hot-rolled steel sheet is measured with a contact-type or non-contact-type thermometer, as long as the measuring portion is the endmost portion in the sheet width direction. When the measuring portion is other than the endmost portion of the hot-rolled steel sheet in the sheet width direction, the temperature is measured with a thermocouple or calculated by heat transfer analysis.

On the other hand, in cooling after coiling, when the hot-rolled steel sheet is cooled so that the upper limit of the retaining time in a predetermined temperature range satisfies Condition II, that is, the hot-rolled steel sheet is cooled so that the retaining time satisfies within 2000 seconds at 450° C. or higher, within 8000 seconds at 400° C. or higher, or within 30000 seconds at 350° C. or higher, austenite can be prevented from decomposing into iron-based carbides and tempered martensite, and the ductility of the hot-rolled steel sheet can be improved. Therefore, the cooling is performed so that the upper limit of the retaining time satisfies Condition II, that is, the upper limit of the retaining time satisfies all of within 2000 seconds at 450° C. or higher, within 8000 seconds at 400° C. or higher, and within 30000 seconds at 350° C. or higher. The cooling rate of the hot-rolled steel sheet after coiling may be controlled by a heat insulating cover, an edge mask, mist cooling, or the like.

EXAMPLES

Next, the effects of one aspect of the present invention will be described more specifically by way of examples, but the conditions in the examples are condition examples adopted for confirming the feasibility and effects of the present invention. The present invention is not limited to these condition examples. The present invention can employ various conditions as long as the object of the present invention is achieved without departing from the gist of the present invention.

Steels having chemical compositions shown in Steel Nos. A to S in Tables 1 and 2 were melted and continuously cast to manufacture slabs having a thickness of 240 to 300 mm. The obtained slabs were used to obtain hot-rolled steel sheets shown in Table 5 under the manufacturing conditions shown in Tables 3 and 4. The slab was allowed to retain in the temperature range of 850° C. to 1100° C. for the retaining time shown in Table 3, and then heated to the heating temperature shown in Table 3 and retained.

For the obtained hot-rolled steel sheet, the area fraction of the residual austenite, $L_{52}/L_7$, and standard deviation of Mn concentration were determined by the above-described method. The obtained measurement results are shown in Table 5.

Evaluation Method of Properties of Hot-Rolled Steel Sheet (1) Tensile Strength Properties and Total Elongation Among the mechanical properties of the obtained hot-rolled steel sheet, the tensile strength properties and the total elongation were evaluated according to JIS Z 2241: 2011. A test piece was a No. 5 test piece of JIS Z 2241: 2011. The sampling position of the tensile test piece may be 1/4 portion from the end portion in the sheet width direction, and the direction perpendicular to the rolling direction was the longitudinal direction.

In a case where the tensile strength TS>980 MPa and the tensile strength TS×total elongation El≥16000 (MPa·%) were satisfied, the hot-rolled steel sheet was determined to be as acceptable as a hot-rolled steel sheet having excellent strength and ductility.

(2) Shearing Workability

The shearing workability of the hot-rolled steel sheet was measured by a punching test. Five punched holes were prepared with a hole diameter of 10 mm, a clearance of 10%, and a punching speed of 3 m/s. Next, a cross section of the punched hole parallel to the rolling direction was embedded in a resin, and the cross section shape was imaged with a scanning electron microscope. In the obtained observation photograph, the processed cross section as shown in FIG. 1 could be observed. In observation photograph, a straight line (the straight line 1 in FIG. 1) perpendicular to the upper and lower faces of the hot-rolled steel sheet and passing through an apex A of the burr (the point farthest from the lower face of the hot-rolled steel sheet in a burr portion in the sheet thickness direction), and a straight line (the straight line 2 in FIG. 1) that is perpendicular to the upper and lower surfaces of the hot-rolled steel sheet and passes through the position B of closest to the punched hole (farthest from the straight line 1) in the cross section were drawn and a distance between two straight lines (d in FIG. 1) was defined as the height difference on the end surface. When the height difference was measured for 10 end surfaces obtained by five punched holes and an average value of the height differences on the end surfaces was 15% or less of the sheet thickness (the average value (mm) of the height differences on end surfaces/sheet thickness (mm)×100≤15), it was determined to be acceptable as a hot-rolled steel sheet having excellent shearing workability. On the other hand, if the average value of the height differences on the end surfaces was more than 15% of the sheet thickness (average value (mm) of the height differences on end surface/sheet thickness (mm)×100>15), it was determined to be non-acceptable as a hot-rolled steel sheet poor in shearing workability.

The obtained measurement results are shown in Table 5.

TABLE 1

| Steel | Mass % Remainder consisting of Fe and impurities | | | | | | | | | | | | | | | |
|---|---|---|---|---|---|---|---|---|---|---|---|---|---|---|---|---|
| No. | C | Si | Mn | sol, Al | P | S | N | O | Ti | Nb | V | Cu | Cr | Mo | Ni | B |
| A | 0.127 | 2.09 | 2.12 | 0.026 | 0.019 | 0.0057 | 0.0066 | 0.0062 | | | | | | | | |
| B | 0.196 | 2.17 | 1.90 | 0.024 | 0.014 | 0.0014 | 0.0070 | 0.0031 | | | | | | | | |
| C | 0.249 | 2.07 | 2.14 | 0.019 | 0.020 | 0.0037 | 0.0104 | 0.0004 | | | | | | | | |
| D | 0.222 | 0.37 | 2.59 | 1.506 | 0.031 | 0.0010 | 0.0063 | 0.0032 | | | | | | | | |
| E | 0.195 | 2.80 | 2.08 | 0.031 | 0.020 | 0.0036 | 0.0064 | 0.0013 | | | | | | | | |
| F | 0.206 | 2.01 | 1.12 | 0.032 | 0.013 | 0.0087 | 0.0020 | 0.0001 | | | | | | | | |
| G | 0.211 | 2.18 | 3.40 | 0.021 | 0.021 | 0.0004 | 0.0058 | 0.0057 | | | | | | | | |
| H | 0.192 | 1.91 | 1.89 | 0.030 | 0.021 | 0.0023 | 0.0024 | 0.0024 | | 0.020 | | | | | | |
| I | 0.183 | 1.97 | 2.04 | 0.020 | 0.012 | 0.0009 | 0.0017 | 0.0014 | 0.031 | | | | | | | |
| J | 0.215 | 1.89 | 2.11 | 0.025 | 0.028 | 0.0064 | 0.0063 | 0.0062 | | | 0.031 | | | | | |
| K | 0.213 | 2.06 | 1.94 | 0.022 | 0.018 | 0.0036 | 0.0055 | 0.0018 | | | 0.032 | 0.02 | | | | |
| L | 0.216 | 1.88 | 2.14 | 0.020 | 0.025 | 0.0048 | 0.0068 | 0.0038 | | | | | 0.21 | | | |
| M | 0.204 | 1.92 | 1.99 | 0.032 | 0.016 | 0.0133 | 0.0040 | 0.0001 | | | | | | 0.100 | | |
| N | 0.214 | 1.91 | 1.90 | 0.033 | 0.009 | 0.0068 | 0.0036 | 0.0072 | | | | | | | 0.36 | |
| O | 0.202 | 2.20 | 2.06 | 0.025 | 0.021 | 0.0028 | 0.0061 | 0.0003 | | | | | | | | 0.0017 |
| P | 0.093 | 1.97 | 2.04 | 0.027 | 0.023 | 0.0062 | 0.0026 | 0.0010 | | | | | | | | |
| Q | 0.297 | 2.02 | 2.16 | 0.028 | 0.016 | 0.0036 | 0.0113 | 0.0042 | | | | | | | | |
| R | 0.198 | 0.02 | 2.11 | 0.029 | 0.015 | 0.0032 | 0.0015 | 0.0029 | | | | | | | | |
| S | 0.186 | 2.02 | 0.85 | 0.028 | 0.021 | 0.0087 | 0.0029 | 0.0023 | | | | | | | | |

An underline indicates that the value is outside a range of the present invention.

TABLE 2

| Steel | Mass % Remainder consisting of Fe and impurities | | | | | | | | | | | | |
|---|---|---|---|---|---|---|---|---|---|---|---|---|---|
| No. | Ca | Mg | REM | Bi | Zr | Co | Zn | W | Sn | T1 | T2 | T3 | Remarks |
| A | 0.0018 | 0.0020 | | | | | | | | 732 | 545 | 461 | Invention Example |
| B | | | | | | | | | | 720 | 546 | 435 | Invention Example |
| C | | | 0.0011 | | | | | | | 679 | 510 | 402 | Invention Example |
| D | | | | 0.002 | | | | | | 989 | 477 | 400 | Invention Example |
| E | | | | | | | | | | 726 | 531 | 430 | Invention Example |
| F | | | | | | | | | | 768 | 614 | 457 | Invention Example |
| G | | | | | | | | | | 612 | 407 | 379 | Invention Example |
| H | | | | | 0.07 | | | | | 718 | 548 | 438 | Invention Example |
| I | | | | | | | | | | 710 | 537 | 437 | Invention Example |
| J | | | | | | | | 0.03 | | 692 | 522 | 420 | Invention Example |
| K | | | | | | 0.07 | | | | 707 | 538 | 426 | Invention Example |
| L | | | | | | | | | | 683 | 505 | 415 | Invention Example |
| M | | | | | | | | | 0.015 | 707 | 527 | 427 | Invention Example |
| N | | | | | | | | | | 696 | 528 | 421 | Invention Example |
| O | | | | | | | 0.13 | | | 708 | 530 | 427 | Invention Example |
| P | | | | | | | | | | 748 | 562 | 480 | Comparative Example |
| Q | | | | | | | | | | 660 | 496 | 379 | Comparative Example |
| R | | | | | | | | | | 653 | 526 | 427 | Comparative Example |
| S | | | | | | | | | | 793 | 644 | 475 | Comparative Example |

TABLE 3

| | | Slab heating | | | Hot rolling | | |
|---|---|---|---|---|---|---|---|
| | | | | | Sheet thickness | | Hot rolling |
| Manufacturing No. | Steel No. | Retaining time s | Heating temperature ° C. | Retention time s | reduction at 850° C. to 1100° C. % | T1 | completion temperature ° C. |
| 1 | A | 1327 | 1202 | 8759 | 91 | 732 | 881 |
| 2 | B | 1409 | 1230 | 8168 | 92 | 720 | 890 |
| 3 | B | 834 | 1222 | 7304 | 92 | 720 | 895 |
| 4 | B | 850 | 1262 | 6857 | 92 | 720 | 891 |
| 5 | B | 1257 | 1230 | 5540 | 92 | 720 | 906 |
| 6 | B | 1240 | 1216 | 7800 | 87 | 720 | 905 |
| 7 | B | 1256 | 1217 | 7676 | 90 | 720 | 719 |
| 8 | B | 1465 | 1195 | 7954 | 91 | 720 | 905 |
| 9 | B | 1414 | 1229 | 7277 | 91 | 720 | 912 |
| 10 | B | 1308 | 1226 | 8586 | 93 | 720 | 898 |
| 11 | B | 1423 | 1220 | 6959 | 90 | 720 | 906 |
| 12 | B | 1134 | 1209 | 7304 | 93 | 720 | 900 |
| 13 | B | 1134 | 1226 | 8544 | 93 | 720 | 900 |
| 14 | B | 1457 | 1200 | 7180 | 93 | 720 | 919 |
| 15 | B | 1257 | 1198 | 7786 | 92 | 720 | 906 |
| 16 | B | 1168 | 1219 | 8670 | 93 | 720 | 902 |
| 17 | C | 1373 | 1190 | 8492 | 92 | 679 | 899 |
| 18 | D | 1360 | 1233 | 7524 | 90 | 989 | 1005 |
| 19 | E | 1344 | 1214 | 7543 | 91 | 726 | 897 |
| 20 | F | 1475 | 1225 | 8101 | 92 | 768 | 911 |
| 21 | G | 913 | 1196 | 8079 | 91 | 612 | 884 |
| 22 | H | 1449 | 1191 | 7909 | 91 | 718 | 900 |
| 23 | I | 1258 | 1202 | 9045 | 91 | 710 | 917 |
| 24 | J | 1282 | 1222 | 8592 | 92 | 692 | 904 |
| 25 | K | 1574 | 1200 | 8052 | 91 | 707 | 900 |
| 26 | L | 1415 | 1216 | 7848 | 90 | 683 | 882 |
| 27 | M | 1208 | 1194 | 8679 | 91 | 707 | 903 |
| 28 | N | 1335 | 1234 | 8763 | 93 | 696 | 890 |
| 29 | O | 1367 | 1205 | 7265 | 92 | 708 | 902 |
| 30 | P | 1566 | 1232 | 8738 | 93 | 748 | 895 |
| 31 | Q | 1464 | 1193 | 8847 | 91 | 660 | 880 |
| 32 | R | 1159 | 1206 | 8232 | 92 | 653 | 899 |
| 33 | S | 1402 | 1233 | 7633 | 93 | 793 | 887 |

| | Cooling | | | | |
|---|---|---|---|---|---|
| Manufacturing No. | Time until cooling start sec | Average cooling rate of accelerated cooling ° C./s | T2 | Cooling stop temperature of accelerated cooling ° C. | Average cooling rate from cooling stop temperature of accelerated cooling to coiling temperature ° C./s |
| 1 | 1.1 | 64 | 545 | 494 | 29 |
| 2 | 0.7 | 84 | 546 | 469 | 31 |
| 3 | 1.0 | 70 | 546 | 462 | 28 |
| 4 | 1.0 | 75 | 546 | 465 | 29 |
| 5 | 0.8 | 64 | 546 | 465 | 30 |
| 6 | 0.9 | 88 | 546 | 466 | 16 |
| 7 | 1.1 | 117 | 546 | 469 | 15 |
| 8 | 1.8 | 110 | 546 | 466 | 25 |
| 9 | 1.0 | 43 | 546 | 459 | 22 |
| 10 | 0.6 | 109 | 546 | 583 | 21 |
| 11 | 1.1 | 121 | 546 | 469 | 6 |
| 12 | 0.9 | 73 | 546 | 461 | 24 |
| 13 | 0.9 | 73 | 546 | 472 | 24 |
| 14 | 1.1 | 87 | 546 | 483 | 16 |
| 15 | 0.8 | 64 | 546 | 465 | 18 |
| 16 | 1.0 | 91 | 546 | 462 | 21 |
| 17 | 1.1 | 92 | 510 | 440 | 27 |
| 18 | 0.6 | 100 | 477 | 432 | 15 |
| 19 | 0.9 | 108 | 531 | 465 | 25 |
| 20 | 0.6 | 79 | 614 | 494 | 22 |
| 21 | 0.7 | 77 | 407 | 404 | 27 |
| 22 | 0.8 | 76 | 548 | 465 | 28 |
| 23 | 0.8 | 94 | 537 | 474 | 24 |
| 24 | 1.1 | 112 | 522 | 444 | 30 |
| 25 | 1.0 | 80 | 538 | 460 | 30 |
| 26 | 0.9 | 111 | 505 | 442 | 26 |
| 27 | 0.9 | 74 | 527 | 456 | 19 |
| 28 | 0.9 | 108 | 528 | 448 | 27 |
| 29 | 0.6 | 119 | 530 | 454 | 30 |

TABLE 3-continued

| | | | | | |
|---|---|---|---|---|---|
| 30 | 1.0 | 118 | 562 | 514 | 30 |
| 31 | 0.8 | 93 | 496 | 415 | 27 |
| 32 | 0.9 | 109 | 526 | 465 | 24 |
| 33 | 1.0 | 93 | 644 | 510 | 17 |

An underline indicates that the value is outside a preferable manufacturing condition.

TABLE 4

| | | Coiling | | Cooling after coiling | | | |
|---|---|---|---|---|---|---|---|
| Manufacturing No. | Steel No. | T3 | ° C. | Retaining time Coiling temperature s | Retaining time at 450° C. or higher s | Retaining time at 400° C. or higher s | at 350° C. or higher Remarks |
| 1 | A | 461 | 465 | 1000 | 4600 | 12800 | Invention Example |
| 2 | B | 435 | 464 | 800 | 4500 | 12700 | Invention Example |
| 3 | B | 435 | 442 | 700 | 4300 | 11500 | Comparative Example |
| 4 | B | 435 | 439 | 0 | 2500 | 12700 | Comparative Example |
| 5 | B | 435 | 437 | 0 | 3200 | 12800 | Comparative Example |
| 6 | B | 435 | 436 | 0 | 2500 | 8700 | Comparative Example |
| 7 | B | 435 | 452 | 0 | 3600 | 9800 | Comparative Example |
| 8 | B | 435 | 439 | 0 | 3000 | 11200 | Comparative Example |
| 9 | B | 435 | 437 | 0 | 2800 | 8000 | Comparative Example |
| 10 | B | 435 | 443 | 0 | 3000 | 12200 | Comparative Example |
| 11 | B | 435 | 461 | 700 | 4300 | 9500 | Comparative Example |
| 12 | B | 435 | 354 | 0 | 0 | 1300 | Comparative Example |
| 13 | B | 435 | 438 | 0 | 100 | 700 | Comparative Example |
| 14 | B | 435 | 472 | 2100 | 5400 | 13600 | Comparative Example |
| 15 | B | 435 | 449 | 0 | 9000 | 17200 | Comparative Example |
| 16 | B | 435 | 439 | 0 | 7000 | 33000 | Comparative Example |
| 17 | C | 402 | 404 | 0 | 100 | 8300 | Invention Example |
| 18 | D | 400 | 412 | 0 | 800 | 8000 | Invention Example |
| 19 | E | 430 | 435 | 0 | 2700 | 10900 | Invention Example |
| 20 | F | 457 | 459 | 600 | 4200 | 9400 | Invention Example |
| 21 | G | 379 | 381 | 0 | 0 | 2200 | Invention Example |
| 22 | H | 438 | 452 | 200 | 4200 | 12400 | Invention Example |
| 23 | I | 437 | 457 | 500 | 4300 | 9500 | Invention Example |
| 24 | J | 420 | 440 | 0 | 2800 | 8000 | Invention Example |
| 25 | K | 426 | 452 | 0 | 3900 | 11100 | Invention Example |
| 26 | L | 415 | 425 | 0 | 1800 | 11000 | Invention Example |
| 27 | M | 427 | 450 | 0 | 3600 | 9800 | Invention Example |
| 28 | N | 421 | 423 | 0 | 1700 | 6900 | Invention Example |
| 29 | O | 427 | 448 | 0 | 3600 | 9800 | Invention Example |
| 30 | P | 480 | 500 | 1900 | 5900 | 14100 | Comparative Example |
| 31 | Q | 379 | 400 | 0 | 0 | 7200 | Comparative Example |
| 32 | R | 427 | 440 | 0 | 2900 | 12100 | Comparative Example |
| 33 | S | 475 | 481 | 1700 | 5300 | 14500 | Comparative Example |

An underline indicates that the value is outside a preferable manufacturing condition.

TABLE 5

| Manufacturing No. | Sheet thickness mm | Residual austenite Area % | $L_{52}/L_7$ — | Standard deviation of Mn Mass % | Tensile strength TS MPa | Total elongation EL % | TS × EL MPa % | Height difference on end surface/ Sheet thickness % | Remarks |
|---|---|---|---|---|---|---|---|---|---|
| 1 | 2.3 | 6.4 | 0.15 | 0.44 | 1017 | 16.4 | 16679 | 13 | Invention Example |
| 2 | 2.3 | 12.4 | 0.12 | 0.40 | 1105 | 20.1 | 22211 | 9 | Invention Example |
| 3 | 2.3 | 11.0 | 0.17 | 0.70 | 1025 | 19.0 | 19475 | 20 | Comparative Example |
| 4 | 2.3 | 10.8 | 0.13 | 0.68 | 1045 | 18.2 | 19019 | 18 | Comparative Example |
| 5 | 2.3 | 11.2 | 0.13 | 0.71 | 1057 | 19.2 | 20294 | 18 | Comparative Example |
| 6 | 2.3 | 12.2 | 0.13 | 0.62 | 1062 | 19.5 | 20709 | 17 | Comparative Example |
| 7 | 2.3 | 15.2 | 0.11 | 0.42 | 916 | 22.8 | 20885 | 11 | Comparative Example |
| 8 | 2.3 | 10.9 | 0.11 | 0.40 | 950 | 20.3 | 19285 | 11 | Comparative Example |
| 9 | 2.3 | 13.5 | 0.12 | 0.41 | 942 | 18.4 | 17333 | 10 | Comparative Example |
| 10 | 2.3 | 14.4 | 0.18 | 0.40 | 960 | 17.2 | 16512 | 13 | Comparative Example |
| 11 | 2.3 | 10.9 | 0.16 | 0.42 | 916 | 14.8 | 13557 | 12 | Comparative Example |
| 12 | 2.3 | 8.1 | 0.23 | 0.43 | 1235 | 15.2 | 18772 | 23 | Comparative Example |
| 13 | 2.3 | 0.5 | 0.14 | 0.41 | 1134 | 10.2 | 11567 | 9 | Comparative Example |
| 14 | 2.3 | 0.6 | 0.15 | 0.41 | 1108 | 11.0 | 12188 | 11 | Comparative Example |

TABLE 5-continued

| Manufacturing No. | Sheet thickness mm | Residual austenite Area % | $L_{52}/L_7$ — | Standard deviation of Mn Mass % | Tensile strength TS MPa | Total elongation EL % | TS × EL MPa % | Height difference on end surface/ Sheet thickness % | Remarks |
|---|---|---|---|---|---|---|---|---|---|
| 15 | 2.3 | 1.1 | 0.13 | 0.42 | 1137 | 9.7 | 11029 | 12 | Comparative Example |
| 16 | 2.3 | 1.7 | 0.17 | 0.41 | 1204 | 10.5 | 12642 | 11 | Comparative Example |
| 17 | 2.3 | 5.2 | 0.18 | 0.45 | 1102 | 15.8 | 17412 | 8 | Invention Example |
| 18 | 1.6 | 6.0 | 0.18 | 0.56 | 1055 | 16.3 | 17197 | 8 | Invention Example |
| 19 | 2.3 | 13.9 | 0.10 | 0.45 | 1099 | 14.9 | 16375 | 8 | Invention Example |
| 20 | 2.3 | 4.2 | 0.16 | 0.23 | 983 | 17.0 | 16711 | 13 | Invention Example |
| 21 | 2.3 | 3.2 | 0.18 | 0.60 | 1130 | 14.7 | 16611 | 15 | Invention Example |
| 22 | 6.0 | 14.8 | 0.14 | 0.40 | 1124 | 17.3 | 19445 | 13 | Invention Example |
| 23 | 2.3 | 12.6 | 0.15 | 0.43 | 1122 | 18.5 | 20757 | 8 | Invention Example |
| 24 | 2.6 | 14.5 | 0.12 | 0.44 | 1118 | 19.5 | 21801 | 9 | Invention Example |
| 25 | 2.6 | 10.8 | 0.15 | 0.40 | 1093 | 18.3 | 20002 | 8 | Invention Example |
| 26 | 2.6 | 12.2 | 0.11 | 0.45 | 1036 | 18.7 | 19373 | 11 | Invention Example |
| 27 | 2.6 | 14.5 | 0.16 | 0.43 | 1029 | 17.6 | 18110 | 10 | Invention Example |
| 28 | 2.6 | 13.9 | 0:16 | 0.39 | 1047 | 20.3 | 21251 | 11 | Invention Example |
| 29 | 2.6 | 12.8 | 0.16 | 0.45 | 1037 | 19.0 | 19703 | 13 | Invention Example |
| 30 | 2.6 | 1.3 | 0.18 | 0.40 | 871 | 16.4 | 14284 | 9 | Comparative Example |
| 31 | 2.6 | 2.5 | 0.18 | 0.44 | 1127 | 12.5 | 14088 | 13 | Comparative Example |
| 32 | 2.6 | 0.2 | 0.12 | 0.46 | 981 | 16.2 | 15892 | 13 | Comparative Example |
| 33 | 2.6 | 4.3 | 0.16 | 0.18 | 870 | 18.0 | 15660 | 12 | Comparative Example |

An underline indicates that the value is outside a range of the present invention.

As can be seen from Table 5, the production Nos. 1, 2, and 17 to 29 according to Invention Example, hot-rolled steel sheets having excellent strength, ductility and shearing workability were obtained.

On the other hand, the production Nos. 3 to 16 and 30 to 33 in which a chemical composition and a metal microstructure are not within the range specified in the present invention were inferior in any one or more of the properties (tensile strength TS, total elongation EL, and shearing workability).

INDUSTRIAL APPLICABILITY

According to the above aspect of the present invention, it is possible to provide a hot-rolled steel sheet having excellent strength, ductility, and shearing workability.

The hot-rolled steel sheet according to the above aspect of the present invention is suitable as an industrial material used for vehicle members, mechanical structural members, and building members.

The invention claimed is:

1. A hot-rolled steel sheet comprising: as a chemical composition, by mass %:

C: 0.100% to 0.250%;
Si: 0.05% to 3.00%;
Mn: 1.00% to 4.00%;
sol. Al: 0.001% to 2.000%;
P: 0.100% or less;
S: 0.0300% or less;
N: 0.1000% or less;
O: 0.0100% or less;
Ti: 0% to 0.300%;
Nb: 0% to 0.100%;
V: 0% to 0.500%;
Cu: 0% to 2.00%;
Cr: 0% to 2.00%;
Mo: 0% to 1.000%;
Ni: 0% to 2.00%;
B: 0% to 0.0100%;
Ca: 0% to 0.0200%;
Mg: 0% to 0.0200%;
REM: 0% to 0.1000%;
Bi: 0% to 0.020%;
one or two or more of Zr, Co, Zn, and W: 0% to 1.00% in total;
Sn: 0% to 0.050%; and
a remainder comprising Fe and impurities,
wherein a metal microstructure at a depth of ¼ of a sheet thickness from a surface and at a center position in a sheet width direction in a cross section parallel to a rolling direction
contains, by area %, 3.0% or more of residual austenite,
has a ratio $L_{52}/L_7$ of a length $L_{52}$ of a grain boundary having a crystal orientation difference of 52° to a length $L_7$ of a grain boundary having a crystal orientation difference of 7° about a <110> direction of 0.10 or more and 0.18 or less,
has a standard deviation of a Mn concentration of 0.60 mass % or less, and
has a tensile strength of 980 MPa or more.

2. The hot-rolled steel sheet according to claim 1,
wherein the hot-rolled steel sheet includes, as the chemical composition, by mass %, one or two or more selected from the group consisting of:
Ti: 0.005% to 0.300%,
Nb: 0.005% to 0.100%,
V: 0.005% to 0.500%,
Cu: 0.01% to 2.00%,
Cr: 0.01% to 2.00%,
Mo: 0.010% to 1.000%,
Ni: 0.02% to 2.00%,
B: 0.0001% to 0.0100%,
Ca: 0.0005% to 0.0200%,
Mg: 0.0005% to 0.0200%,
REM: 0.0005% to 0.1000%, and
Bi: 0.0005% to 0.020%.

* * * * *